United States Patent [19]

Bergland

[11] 4,355,795

[45] Oct. 26, 1982

[54] SHEET HANDLING DEVICE

[75] Inventor: Paul W. Bergland, Montville, N.J.

[73] Assignee: Bobst Champlain, Inc., Roseland, N.J.

[21] Appl. No.: 127,142

[22] Filed: Mar. 4, 1980

[51] Int. Cl.[3] ..... B65H 39/06

[52] U.S. Cl. ..... 270/58

[58] Field of Search ..... 270/58, 60, 54, 45, 270/51, 46, 59; 198/420, 422, 425, 461

[56] References Cited

U.S. PATENT DOCUMENTS

| | | | |
|---|---|---|---|
| Re. 12,051 | 11/1902 | Firm | 270/46 |
| 226,916 | 4/1880 | Hoe | 414/134 |
| 277,548 | 5/1883 | Crowell | 270/46 |
| 318,143 | 5/1885 | Scott | 270/45 |
| 3,271,023 | 9/1966 | Disbrow | 270/58 |
| 3,363,739 | 1/1968 | Mebus | 198/461 |
| 3,520,395 | 7/1970 | Jablonski | 198/422 |
| 3,614,087 | 10/1971 | Zernov | 270/60 |
| 3,977,665 | 8/1976 | Bowman | 270/54 |
| 4,149,711 | 4/1979 | Jackson | 270/57 |

*Primary Examiner*—Richard J. Apley
*Assistant Examiner*—A. Heinz
*Attorney, Agent, or Firm*—Hill, Van Santen, Steadman, Chiara & Simpson

[57] ABSTRACT

A sheet handling device for receiving a flow of sheets from a discharge end of a processing apparatus and the delivering the sheets into an input end of a second processing apparatus characterized by a first conveying path of belts extending between an input end and exit end of the device, a second conveying path of belts having a longer or greater length than the first path extending from the input end to the exit end, nip rollers forcing the belts of each path into engagement with each of the sheets in the first and second paths to impart a new speed thereto, the ends of the first and second paths being arranged so that a sheet in the second will be deposited on a following sheet traveling in the first path, and a device arranged adjacent the input ends of each of the paths for alternately directing the sheets into said paths.

9 Claims, 6 Drawing Figures

SHEET HANDLING DEVICE

BACKGROUND OF THE INVENTION

A sheet handling device receiving a flow of successive sheets from a sheet processing apparatus, collecting the sheets into pairs of superimposed sheets and discharging each pair to a further processing machine at a reduced speed.

The sheet handling device of the present invention is preferably located between a carton blank processing apparatus, which produces a sheet of interconnected carton blanks, and a delivery unit, which will separate a sheet of interconnected blanks into individual blanks. In these devices, the carton blank processing machine such as a platen press, which performs steps of cutting, creasing and stripping, can operate at a faster speed than a device which receives a stripped sheet of interconnected blanks and proceeds to separate the sheet into individual blanks. To compensate for this difference, it has been proposed to interpose a collecting device, which will deposit a sheet of blanks in a flow of sheets being received onto the next following sheet and then reduce the speed of the two superimposed sheets to one half of the previous speed for delivery to the delivery station with the sheet separating arrangement. An example of such a device is disclosed in U.S. Pat. No. 3,614,087. While this device or apparatus will enable reducing the speed of the two superimposed sheets to a speed in which a delivery unit can handle the sheets, certain problems occur. First of all, the control of the position of the two sheets relative to each other to obtain a desired registration therebetween is difficult because of the speed of the travel of the sheets during the movement in the two paths to enable bringing them to the superimposed relationship. Another problem is that the means for reducing the speed of the superimposed or married sheets grips each of the two sheets in the superimposed relationship only on one side and therefore slippage between the two superimposed sheets can occur to cause misregistration.

SUMMARY OF THE INVENTION

The present invention is directed to providing a sheet handling device which enables an improved registration between the two sheets being superimposed into the married relationship and does not have problems with slippage between the sheets after they have been superimposed together and prior to delivery to the next processing station.

To accomplish these tasks, the present invention provides a sheet handling device for receiving a flow of sheets from a discharged end of a processing apparatus and discharging the sheets into an input end of a second processing apparatus said device having a frame with an input end and an exit end; first means for forming a first path between input and exit ends; second means for forming a second path between the input and exit ends, said second path being longer than said first path by an amount of approximately equal to ½ the spacing between the leading edges of two successive blanks in the flow of sheets; the exit ends of each of said first and second paths being arranged so that a sheet in said second path is deposited in superimposed relationship with the following sheet of the flow of sheets which is traveling in the first path; and means for selectively directing sheets into said first and second paths, each of said first and second paths having means for imparting a new speed of travel to the sheet traveling therein so that each of the sheets have the desired speed of travel prior to the depositing of the two sheets in a superimposed relationship.

Preferably, the means for imparting the new speed decelerates the sheets to a speed of approximately one half of the initial speed of the sheets entering the device. Each of the means for forming the first and second paths utilizes a plurality of continous ribbon type conveying belts with the means for imparting the new speed being a pair of nip rollers forcing the belts onto the leading edge of a sheet as the trailing edge is released by the conveying means of first processing machine. Thus, each of the sheets is brought to the slower speed prior to arriving at the exit of the first and second paths so that the merging or applying of the sheets into the superimposed or married relationship occurs at a slower speed to enable better control of the registration therebetween. Preferably, both of the means forming the first and second paths are driven from the same power source and one of the means such as the first means includes a transmission to enable varying the speed of the belts of the first path to adjust the position of the leading edge of a sheet therein relative to the sheets of the second path to control registration or to provide a desireable offset. In addition, the transmission enables running the first path at the same or slower speed as the first processing apparatus in the event that the collecting of two sheets in a superimposed relationship is to be bypassed.

The means for selectively directing includes a flipper plate actuated by cam followers engaging a rotating cam surfaces. In order to direct all of the blanks into the first path, the means for directing includes a lock out mechanism which will lock the cam followers in a position where they will not engage at least a portion of the cam during which the blade will be directing the blank in the second path.

It should be noted that each of the pair of nip rollers can be adjusted to urge the coacting arrangements of ribbon belts into tight engagement with the blank at a different position so that blanks of different lengths, which is measured along the direction of travel, can be processed.

DESCRIPTION OF THE PREFERRED EMBODIMENTS

Figure 1:
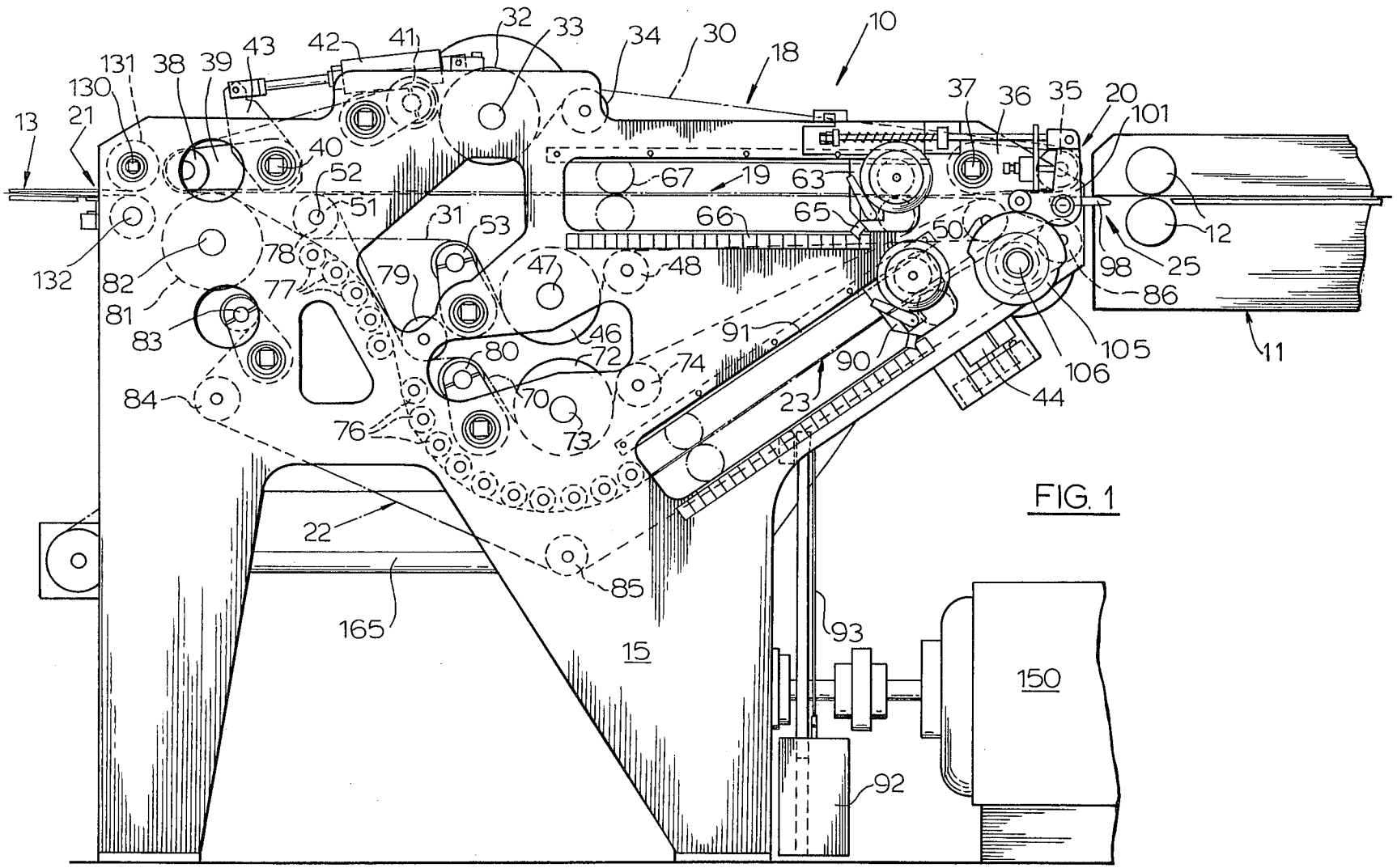
FIG. 1 is a side view of the sheet handling device in accordance with the present invention.

The principles of the present invention are particularly useful in a sheet handling device generally indicated at 10 which is arranged to receive a flow of sheets from a processing apparatus generally indicated at 11, which is, for example, a die cutting and creasing press having a stripper and has a a discharge station defined by a pair of nip rollers 12. The device 10 is arranged to discharge the flow of sheets at a receiving station 13 of a subsequent processing machine such as a delivery device or apparatus. Thus, the device 10 is part of an equipment line having various stations.

The device 10 includes a frame formed by a side frame elements 15 and 16 (see FIG. 3) which support first means, which is generally indicated at 18, for creating a first path, which is generally indicated at 19, between an input end, which is generally indicated at 20 and is adjacent the discharge nip rollers 12 of the apparatus 11 and an exit or output end 21 which is adjacent the subsequent processing device 13. In addition, the frame support means which is generally indicated at 22 and defines a second path 23 that extends between the input end 20 and the output end 21. The frame also supports adjacent the input ends a means or device 25 for alternately directing a blank into either the first path 19 or the second path 23.

Figure 3:
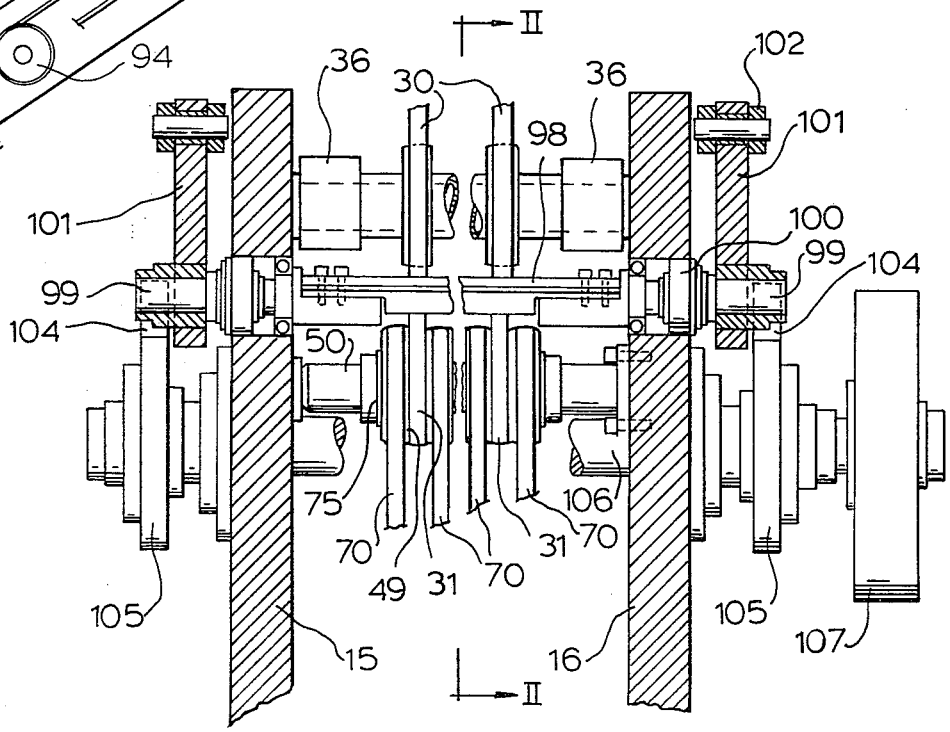
FIG. 3 is a cross sectional view with portions in elevation taken along line III—III of FIG. 2.

The first means 18 utilizes a plurality of upper conveying ribbons or belts 30 and a plurality of lower continuous ribbons or belts 31. These ribbons or belts, which are continuous, are spaced apart as best illustrated in FIG. 3. Each of the upper plurality of spaced apart belts 30 is driven by a drive pulley 32, which is mounted on a drive shaft 33. Each of the belts 30 from the drive pulley 32 extends forward over an idler pulley 34 to a front end pulley or sheave 35 which is mounted on a shaft supported on a pair of pivot arms 36 that pivot about an axis of a shaft 37. From the front pulley 35, the belt extends along the upper path 19 to a rear pulley 38 which is mounted on a shaft supported on pivot arms 39 that pivot about axis 40. From the rear pulley 38 the belt passes over a belt tightner 41 and reengages the drive pulley 32.

Each of the front end pulleys 35 and the rear or back pulley 38 are biased around their respective pivot points against a stop by biasing means. As illustrated, an air cylinder 42 forms a bias means acting on a lever arm 43, which is connected to the arms 39 to bias or rotate them in a counterclockwise direction around a pivot point or shaft 40. In a similar manner, the arms 36 are biased in a clockwise manner by a biasing means such as an air cylinder 44.

Figure 2:
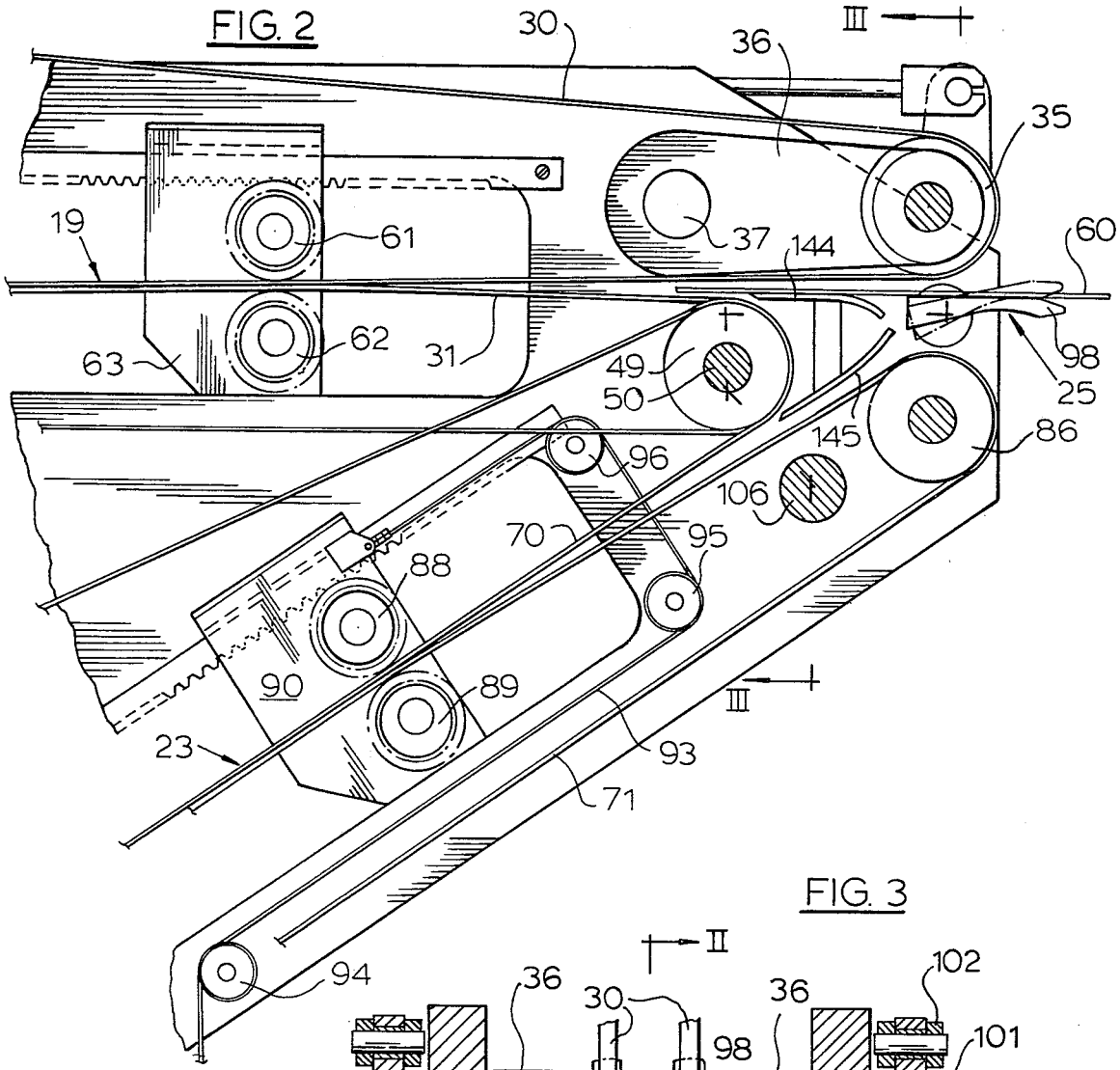
FIG. 2 is an enlarged cross sectional view of an input end of the device taken along line II—II of FIG. 3.

Each of the lower belts 31 of the path 19 have a drive pulley 46 which is mounted on a drive shaft 47. From the drive pulley 46, the individual belts 31 pass over idler pulley 48 to a front or leading edge pulley 49 mounted on a shaft 50. After passing around the pulley 49, the belt extends along the first path 19 to a rear pulley such as 51 mounted on a shaft 52. From the pulley 51, the belt passes over a belt tightner or tensioning pulley 53 and returns to the drive pulley 46. As best illustrated in FIG. 2, the pulleys on the shaft 50, which is fixed in the frame and the front pulley 35, even while biased in its lowest position, are spaced apart so that the belts 30 and 31 are not in tight engagement with each other.

Figure 5:
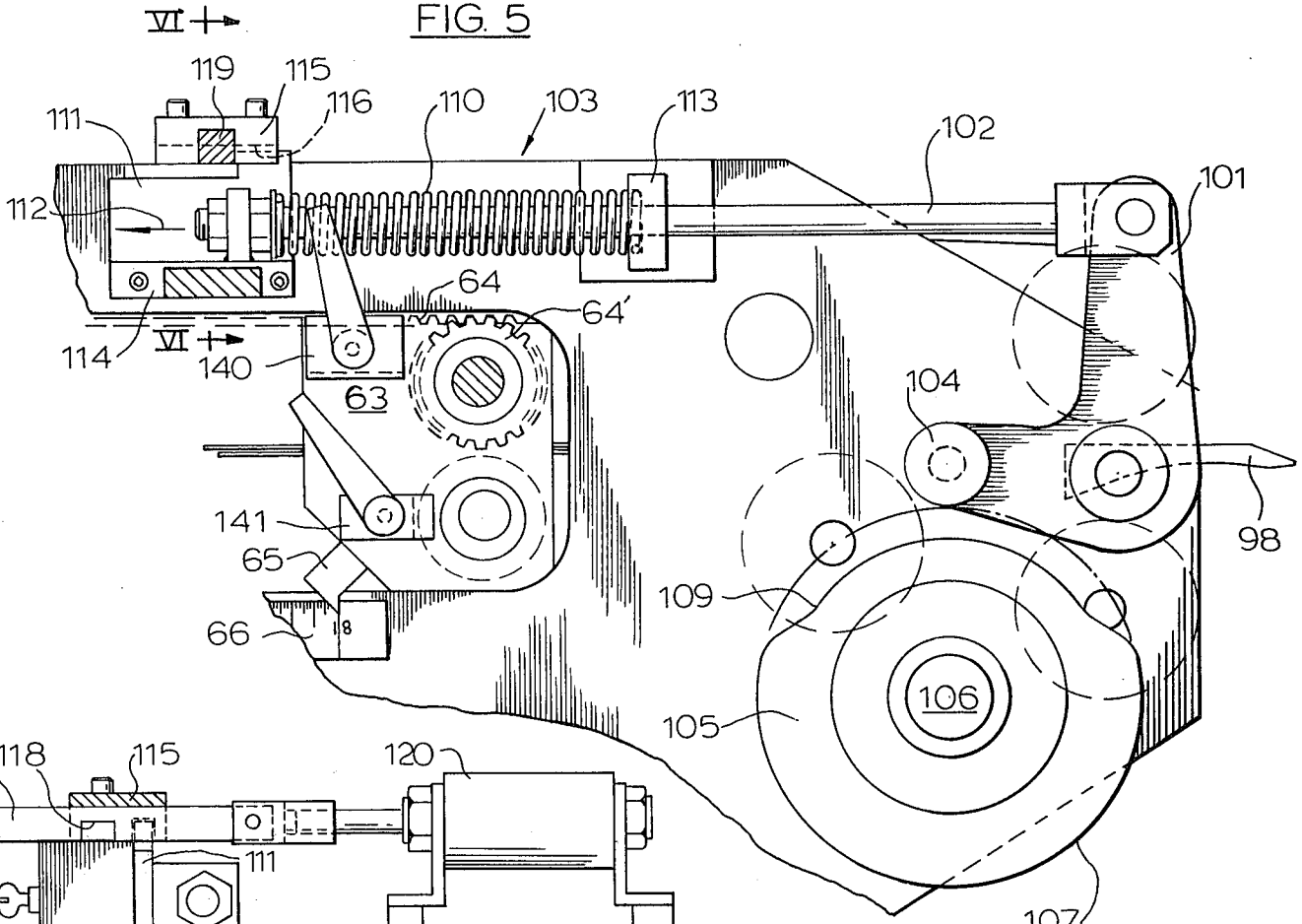
FIG. 5 is an enlarged end view of the input end of the present invention.

To urge the belts 30 and 31 into tight engagement onto a sheet or blank such as a sheet 60, a pair of nip rollers 61 and 62, which are mounted in the housing 63 are provided. The position of the housing 63 can be adjusted by a rack and pinion arrangement in which a pair of racks 64 (FIGS. 2 and 5) are mounted in the frames 15 and 16 along the first path 19 and are engaged by a pinion 64' (FIG. 5). The housing 63 will include an indicator 65, which indicates on a scale 66 the setting for the nip rollers 61 and 62. Briefly if the rolls are moved to the position illustrated in broken lines at 67, a leading end of a sheet 60 will not be engaged by the belts 30 and 31 until it extends between the nip rollers 61 and 62. Thus, the adjustment of the position of the housing 63 will adjust the position of nip rollers 61 and 62 along the path 19 and increase their distance from the nip rollers 12 of the device 11. The purpose of the nip rollers 61 and 62 is to control when the sheet is tightly engaged by the belts 30 and 31 which preferably are moving at a reduced speed with respect to the speed of the sheet while it is engaged by the nip rollers 12. Thus, the nip rollers 61 and 62 are positioned to engage the leading edge of the sheet as the trailing edge passes through and is released by the nip rollers 12 to decelerate or change the speed of the sheets such as 60.

The second means 22 forming the second path 23 includes upper belts 70 and lower belts 71. In a manner similar to the belts of the first path 19, each of the upper belts 70 passes over a drive pulley 72 on a drive shaft 73 around an idler 74 to a lead pulley 75 (FIG. 3) on the shaft 50. From the lead pulley or front end pulley 75 on the shaft 50, the belt passes around a plurality of idler pulleys such as a first group 76 and a second group 77 to a rear pulley 78 on the shaft 52. From the rear pulley it passes over another idler 79 to a tension device 80 and back to the drive pulley 72. Each of the lower belt 71 has a drive pulley 81 mounted on a shaft 82. From the drive pulley 81 the belt passes over a tensioning device or pulley 83, an idler 84, a second idler 85 to a front pulley or sheave 86. From the front pulley 86, each belt extends along the second path 23 through a pair of nip rollers 88 and 89, which are mounted in the housing 90 (FIG. 2). From the nip rollers the belt engages the first group of idlers 76 and the second group of idlers 77 until it is received by the drive pulley 81. As best illustrated in FIG. 3, the pulley 49 for the belts 31 and pulleys 75 for the belts 70 are alternately arranged on shaft 50. The pulleys 51 and 78 are also arranged alternately on shaft 52.

The position of the pulleys on the shaft 50 and the front sheave 86 are such that the belts 70 and 71 are spaced apart until they are forced into engagement with the blank or sheet by the pair of nip rollers 88 and 89. As for the first path, a blank that is deflected into the second path will travel at the speed of the nip rollers 12 of the device 11 until the trailing edge is released thereby and the leading edge is engaged by the nip rollers such as 88 and 89. The position of the nip rollers and the housing 90 which position is adjusted by means of a rack and pinion arrangement having a rack 91, compensates for the length of the blanks being handled. It should be noted that due to the movement along a non-horizontal path, a counter weight 92 (FIG. 1) is connected by a chain 93 around a series of idler rolls 94, 95 and 96 to the housing 90.

To direct each of the blanks alternately into the first and second paths, a means 25 is provided. As best illustrated in FIGS. 1, 2 and 3, the means includes a directing plate or member 98 which is mounted on a pair of shafts 99, each shaft 99 is supported by a beam 100 for pivotable movement in a supported side frame members 15 and 16 and has a portion extending outside of the frame member. As illustrated, a cam lever arm 101, which has an "L" shape, is mounted on each exposed end. An upper portion of each lever arm 101 (FIG. 5) is connected by a link 102 to a biasing means 103 which urges the arm to rotate in a counterclockwise direction as viewed in FIGS. 1 and 5. The other portion of the arm 101 has a cam follower 104 which rides on a cam 105 mounted on a shaft 106 and driven by a pulley 107. As illustrated in FIG. 1 and also FIG. 5, the cams 105 have two different diameter sectors 108 and 109 joined together so that when the larger diameter sector 108 is engaged by the cam follower 104, the arm 101 is moved in a clockwise direction to have the blade 98 in a position to direct the sheets such as 60 into the first path formed by the belts 30 and 31. When the smaller diameter portion 109 is engaged by the follower 103, the arm will be moved in a counterclockwise direction by the biasing means 103 to shift the blade 98 to the position illustrated in broken lines to deflect a blank such as 60 into the second path. As illustrated in FIG. 2, a pair of deflector plates 144 and 145 are provided to aid in directing the sheet into one of the first or second paths. The plate 144 aids in directing the sheet into the first path 19 and the plate 145 aids in directing the sheet into the second path 23.

Figure 6:
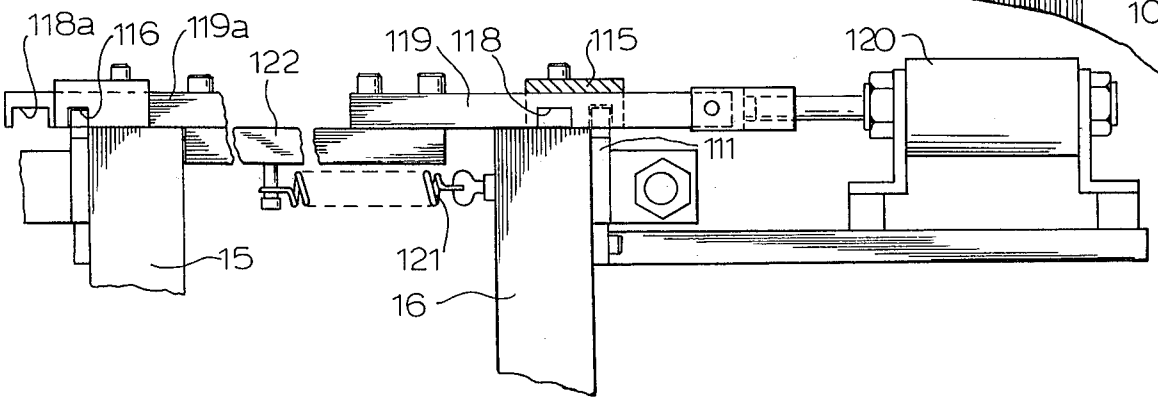
FIG. 6 is a cross sectional view with portions in elevation taken along the line VI—VI of FIG. 5

As best illustrated in FIG. 5, the biasing means 103 for the cam follower 104 comprises a compression spring 110 which urges a L-shape slide member 111 in the direction of arrow 112 away from a fixed stop 113 on the side frame member. The slide member 111 is supported on a guide 114 and held by a plate 115 having slot 116. As illustrated, the portion 117 of the member 111 moves in the slot 116 in the plate 115 and must also pass through a slot 118 in a bar 119. The bar 119 is shiftable in a direction perpendicular to the direction of movement 112 of the slide 111 between a locking position as illustrated in FIG. 6 which prevents movement of the slide 111 in the direction 112 to a position aligned with the slot 116 of the member 115 to allow passage of the portion 117. As illustrated, a biasing means such as an air cylinder 120 urges the bar 119 to the locking position and the bar 119 is moved against the cylinder 120 by a spring 121 to the unlocking position. Since each frame member 15 and 16 has a cam arrangement, a similar device, such as the slide **119*a* is provided on the frame member 15 to lock the cam member mounted on the side actuation. As illustrated 119 and 119*a* are interconnected by a plate 122 which engages the inside surfaces of the frame members 15 and 16 to limit movement in both directions. While in the locking position as illustrated in FIGS. 5 and 6, the cam followers 104 are held in an upright position so that the arm 101 cannot rotate in a counterclockwise direction when the smaller diameter portion 109 passes beneath the follower 104**. While in the locked out position, all blanks or sheets will travel only in the first path. This feature can be utilized when there is no need for passing one sheet in the second path so that it can be superimposed on the following sheet traveling in the first path as discussed hereinbelow.

Referring back to FIG. 1, the second path 23 is longer than the first path 19 preferably by a distance equal to ½ the distance between leading edges of two successive sheets in the device 11. Thus, when a sheet is traveling in the second path 23 and is brought towards the merging area defined by the combination of pulleys 81 and 38, it will be deposited under the following sheet which is traveling in the shorter first path. Thus, the two sheets can be married or superimposed in the desired registration. In addition, since each of the belts in both the first and second paths are moving at a slower speed preferably one half of the linear speed of the sheets while in the machine 11, the sheets will be decelerated to the desired slower speed and then deposited into a superimposed sheet arrangement for discharge through the final discharge nips formed by an idler nip roller 130 and a driven roller 131 which is mounted on a shaft 132 that is mounted on pivot arms. As mentioned hereinabove, each of the nip rollers such as 61 and 62 which were mounted in a housing 63 can be adjusted along the respective path such as the first path 19. As illustrated in FIG. 5, this is accomplished by a gear 64' engaged in a rack 64. After the desired position is reached as indicated on the scale 66 by the indicator 65, clamps 140 can be actuated to clamp the housing in the fixed position.

Figure 4:
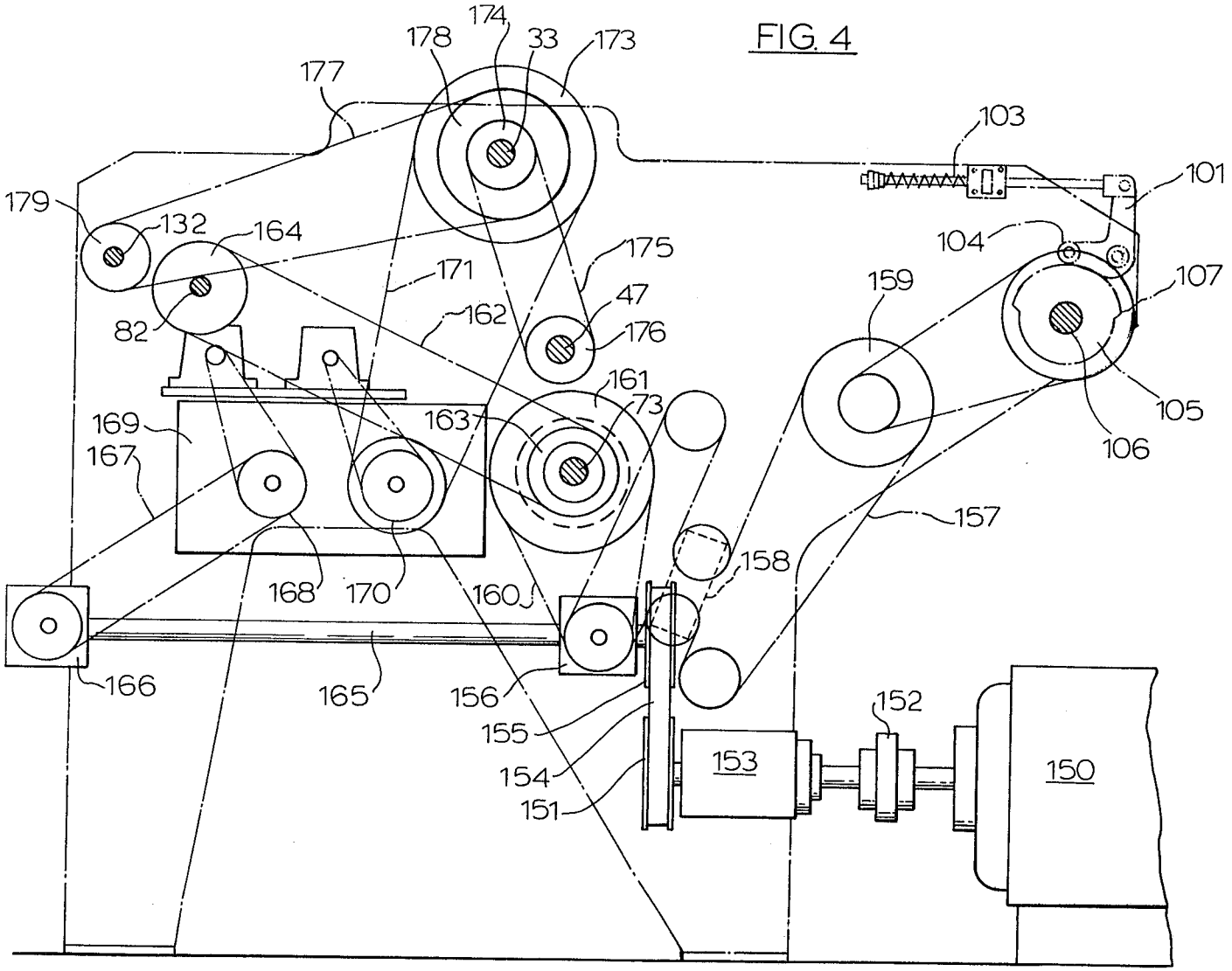
FIG. 4 is a cross sectional view schematically illustrating the power train for the sheet handling device in accordance with the present invention.

The device 10 is driven by a power source 150 which is illustrated as an electric motor but can also be a power source of the processing machine 11. As illustrated in FIG. 4, the device 10 has a drive pulley 151 that is connected via couplings 152 and a clutch arrangement 153 to the source 150. A belt 154 on drive pulleys 151 extends to a pulley 155 of a first angle box 156. From the angle box 156, one belt 157, which has a slide arrangement 158, drives a pulley arrangement 159, which in turn drives a pulley connected to the shaft 106 to rotate the cams 105. Due to the presence of the slide arrangement 158, the angular relationship of the shaft 106 and the respective cams 105 can be adjusted relative to the output of the angle box 156 to enable adjusting the cam to actuate the plate 98 at the desired time.

From the angle box 156, another belt 160 goes to a pulley 161 which is connected to a drive shaft 73 for the drive pulley 72 of the upper belt 70 of the second path 23. In addition, a belt 162 connects a pulley 163 attached to the shaft 73 to a pulley 164 which is attached on the drive shaft 82 for the drive pulley of the lower belt 71 of the second path. It should be noted that the pulley 161 if desired can be provided with a connection including a clutch which enables disconnecting the pulley in the event the lower path is to be disengaged from the drive source.

From the angle box 156, a shaft 165 extends to a second angle box 166. From the angle box 166, a belt 167 extends to an input pulley 168 of a transmission 169. An outlet pulley 170 of the transmission 169 drives a belt 171 which is connected to a pulley arrangement 173 which is coupled to the drive shaft 33 for the drive pulley 32 of upper belt 30 of the first path 19. A pulley 174 on the shaft 33 is connected by a belt 175 to a pulley 176 on shaft 47 for the drive pulley 46 of the lower belt of the path 19. In addition, a drive belt 177 extends from a pulley 178 on shaft 33 to drive pulley 179 that is connected to the shaft 132 of the drive nip roller 131. The transmission 169 can be a conventional transmission, which enables varying the speed of the first path 19 in relation to the speed of the second path 23 so that small adjustments can be made to obtain a desired registration or to obtain a desired overlap between the superimposed sheets. In addition, the transmission can be constructed to enable increasing the speed of the upper first path 19 to be the same as, or less than, the speed of conveying in the device 11 so that when the collecting and superimposing the two sheets is not required, a direct passage along the first path 19 can be utilized.

When a gap or free space exits between adjacent sheets 60 being discharged from the device 11, the belt speeds in the path 19 may be set to be slower than the discharge speed of the device 11 to eliminate the gap or free space between the adjacent sheets and to affect a partial speed reduction in the device 10 which can be beneficial to subsequent sheet processing in the device 13.

As pointed out hereinabove, one of the major advantages of the present device is the fact that when the device is used to collect and superimpose a first sheet of a pair of two following sheets onto the second sheet, the sheets are first slowed down to one half the initial speed prior to being superimposed sheets. Furthermore, since the sheets or blanks when they are brought together in the region of the output of the device have already been decelerated to the desired speed, the possibility of slippage of the two sheets or blanks relative to each other during subsequent handling is reduced since there is no great deceleration force being applied thereto.

Although various minor modifications may be suggested by those versed in the art, it should be understood that I wish to embody within the scop of the patent granted hereon, all such modifications as reasonably and properly come within the scope of my contribution to the art.

I claim:

1. A sheet handling device for receiving a flow of sheets at a given speed of travel from a conveying means at a discharge end of a processing apparatus and discharging the sheets to an input end of a second apparatus, said device comprising a frame with a single input and a single exit; first means mounted in said frame for forming a first path extending between the input and exit; second means mounted in the frame for forming a separate second path extending between the input and exit, said second path having a curved portion and being longer than said first path by an amount approximately equal to one half of a spacing between leading edges of two successive sheets in said flow of sheets in said processing apparatus, each of said first and second means including a plurality of coacting pairs of continuous ribbon belts extending along substantially the entire length of the respective paths from the input to the exit and means for driving said belts at a new constant speed, which is slower than said given speed; means mounted on the frame at the input for selectively directing sheets into said first and second paths; said first means adjacent the input and the means for directing having means for imparting the new speed of travel to each sheet traveling in the first path; said second means adjacent the input and said means for directing having means for imparting the new speed of travel substantially the same as the speed of travel in said first path to each sheet traveling in the second path, each of said means for imparting including a pair of nip rollers and means for mounting each pair of nip rollers on the frame along the respective path to press the coacting pairs of belts onto the leading edge of a sheet in said path as a sheet is released from the conveying means of the processing apparatus; and each of said first and second paths being arranged to merge at a point adjacent the exit of the frame so that the sheets in each of said first and second paths has reached the new speed prior to being discharged from the path and a sheet in the second path is deposited on a following sheet of the flow traveling in the first path at the point of merging of said paths.

2. A sheet handling device according to claim 1, wherein the means for driving the belts in the first path and the second path are driven by the same power source, said means for driving the belts in said first path including transmission means interposed between said source and said means for driving the belts for varying the constant speed of advance of the belts of the first path to vary the speed of a sheet in the first path to enable adjusting a position of the leading edge of the sheet in the first path relative to the leading edge of the sheet being transported in the second path.

3. A sheet handling device according to claim 2, wherein the coacting pairs of belts forming the first path form a straight line path extending between the inlet and the exit, wherein the coacting pairs of belts of the second means extends over substantially the entire length of the second path, and wherein, each of the means for mounting the nip rollers being adjustable along the path to enable handling sheets having different lengths in the direction of movement of the sheets through the device.

4. A sheet handling device according to claim 1, wherein the means for driving the belts for the first and second means are driven by the same power source and the first means includes means for varying the constant speed of the belts of said first path relative to the constant speed of the second path to enable adjusting the position of the leading edge of a sheet therein relative to the leading edge of the sheet being deposited from the second path.

5. A sheet handling device according to claim 1, wherein the means for driving the belts at the new constant speed drives the belts at a speed of travel of approximately one half of the given speed of travel of the sheets entering the device.

6. A sheet handling device according to claim 5, wherein the means for driving the belts at a new constant speed of travel in the first path includes means for adjusting the constant speed of travel of the belts relative to the constant speed of travel of the belts in the second path, said means for adjusting including a setting with the speed of travel of the belts in the first path being approximately the given speed of travel of the sheets entering said device so that all of the sheets can be conveyed in the first path and bypass the second path.

7. A sheet handling device according to claim 6, wherein the means for selectively directing sheets includes means for locking said means for selectively directing in a first position to direct all sheets into said first path and bypass said second path.

8. A sheet handling device according to claim 7, wherein the means for selectively directing includes a rotating cam, a plate mounted on the frame for pivotal movement between a first and second position and a cam follower, said follower being connected to said plate and being engaged on the cam to move the plate between the first position for directing the sheets into the first path and a second position for directing the sheet into the second path, and said means for locking holding said follower and plate in said first position.

9. A sheet handling device according to claim 1, wherein each of the means for mounting a pair of nip rollers is adjustably positioned on the frame along the respective path to enable handling sheets having different lengths in the direction of movement of the sheets through the device.

* * * * *